US007288036B2

(12) United States Patent
Casasanta, Jr.

(10) Patent No.: US 7,288,036 B2
(45) Date of Patent: Oct. 30, 2007

(54) GRIP FOR A HOCKEY STICK WITH A HOLLOW-ENDED SHAFT

(76) Inventor: Joseph G. Casasanta, Jr., 19 Shary La., Auburn, MA (US) 01501

( * ) Notice: Subject to any disclaimer, the term of this patent is extended or adjusted under 35 U.S.C. 154(b) by 0 days.

(21) Appl. No.: 10/542,981

(22) PCT Filed: Jan. 26, 2004

(86) PCT No.: PCT/US2004/001946

§ 371 (c)(1),
(2), (4) Date: Jul. 21, 2005

(87) PCT Pub. No.: WO2004/067100

PCT Pub. Date: Aug. 12, 2004

(65) Prior Publication Data

US 2006/0128508 A1 Jun. 15, 2006

(51) Int. Cl.
*A63B 59/14* (2006.01)

(52) U.S. Cl. ..... 473/560

(58) Field of Classification Search ..... 473/560–563, 473/549–552, 568, 300
See application file for complete search history.

(56) References Cited

U.S. PATENT DOCUMENTS

| | | | | |
|---|---|---|---|---|
| 3,940,134 | A | | 2/1976 | Bieganowski |
| 4,013,288 | A | | 3/1977 | Goverde |
| D264,863 | S | | 6/1982 | Walmsley |
| 4,351,528 | A | | 9/1982 | Duplin |
| 4,553,753 | A | | 11/1985 | Gibbons |
| 4,977,621 | A | | 12/1990 | Richard |
| 5,004,642 | A | | 4/1991 | Youngs |
| 5,005,254 | A | | 4/1991 | Uffindell |
| 5,050,289 | A | | 9/1991 | Uffindell |
| 5,364,677 | A | | 11/1994 | Sendziak |
| 5,452,891 | A | * | 9/1995 | Thomas ..... 473/294 |
| 5,456,463 | A | | 10/1995 | Dolan et al. |
| 5,577,725 | A | | 11/1996 | Pagotto et al. |
| D379,208 | S | | 5/1997 | Kulisek, Jr. |
| 5,797,813 | A | | 8/1998 | Huang |
| 5,823,901 | A | | 10/1998 | Burger |
| 5,857,241 | A | | 1/1999 | Camp, Jr. et al. |
| 5,879,250 | A | | 3/1999 | Tahtinen et al. |
| 5,981,649 | A | | 11/1999 | Hiraoka et al. |
| 6,004,234 | A | | 12/1999 | Majchrowicz |
| 6,024,903 | A | | 2/2000 | Naft et al. |
| D426,448 | S | | 6/2000 | Ferrari et al. |

(Continued)

FOREIGN PATENT DOCUMENTS

| | | |
|---|---|---|
| CA | 2270681 | 11/2000 |

(Continued)

*Primary Examiner*—Mark S Graham
(74) *Attorney, Agent, or Firm*—Guerin & Rodriguez, LLP; Michael Rodriguez

(57) ABSTRACT

Described is a grip for attachment to a sport stick having a shaft. One end of the shaft has a opening extending longitudinally into the shaft. The grip comprises an elongated grip portion having a hilt. The hilt has a longitudinal dimension sized for being grasped by the hand of a user. The grip also comprises an insertion portion at one end of the elongated grip portion. The insertion portion is sized to provide close insertion into the opening at the one end of the shaft.

39 Claims, 11 Drawing Sheets

U.S. PATENT DOCUMENTS

| | | | |
|---|---|---|---|
| D427,502 | S | 7/2000 | Ferrari et al. |
| 6,102,819 | A | 8/2000 | Christian et al. |
| 6,206,793 | B1 | 3/2001 | Burger |
| 6,248,031 | B1 | 6/2001 | Brodie |
| 6,261,191 | B1 | 7/2001 | Chen |
| 6,267,697 | B1 | 7/2001 | Sulenta |
| 6,364,792 | B1 | 4/2002 | Evanochko |
| 6,449,803 | B1 | 9/2002 | McConchie |
| 6,473,939 | B1 | 11/2002 | Stegmaier |
| 6,500,079 | B1 | 12/2002 | Tucker et al. |
| 6,503,153 | B2 | 1/2003 | Wang |
| 6,652,941 | B1 | 11/2003 | Chadwick et al. |
| 2001/0018378 | A1 | 8/2001 | Burger |
| 2003/0045380 | A1 | 3/2003 | Tucker, Sr. |

FOREIGN PATENT DOCUMENTS

| | | | |
|---|---|---|---|
| CH | 685149 | A5 | 4/1995 |

* cited by examiner (Universal)

(Right)

(Left)

GRIP FOR A HOCKEY STICK WITH A HOLLOW-ENDED SHAFT

This application claims the benefit of the filing date of co-pending U.S. patent application Ser. No. 10/350,647, filed Jan. 24, 2003, titled "Grip for a Hockey Stick With a Hollow-Ended Shaft".

FIELD OF THE INVENTION

The invention relates generally to a grip for sport sticks. In particular, the invention relates to a grip for a hollow or partially hollow shaft of a hockey stick.

BACKGROUND

Traditional hockey sticks are made of wood and have a straight rectangular shaft (or handle) with a curved blade at one end of the shaft for handling and shooting a hockey puck. The hockey player holds the hockey stick at the other end of the shaft. The surface of the shaft is smooth and can slide within the player's hands. Typically, the player wears thick gloves, making the hockey stick more difficult to grasp. To improve the grip and keep the stick from sliding out of the player's hands, the player often wraps cloth tape around the end of the shaft to aid in grasping the stick. With tape the player also often builds a knob at the end of the shaft.

In addition to wooden hockey sticks, industry has produced hockey sticks of different material, such as plastic, which offers a safer alternative to the wooden stick and proves gentler to gymnasium floors (useful for floor hockey). Industry has also recently produced hockey sticks of aluminum and composite construction. Such hockey sticks are lighter in weight and have greater durability than the traditional wooden hockey sticks. Notwithstanding such improvements, these new-construction hockey sticks are similar to their traditional wooden counterparts in that they, too, have straight rectangular shafts and are therefore difficult to hold. Accordingly, the traditional method of using tape to produce a handgrip and a knob has carried over to the newer aluminum and composite-type sticks. As with the wooden sticks, however, these taped grips are awkward to use because the taped grip is predominately rectangular in shape, making it difficult and at times uncomfortable to hold with ungloved or gloved hands. Typically, taped grips are also unsightly and wear out quickly.

This discomfort and unsightliness associated with taped grips has led to the development of hockey stick grips that seek to improve stick handling comfort, style, and ease of use. Canadian Patent Application No. 2,270,681, published on Nov. 4, 2000, discloses an example of a resilient grip with a protrusion that rounds out one side to fit the palm of a player's hand. This grip has a handle recess (or sleeve) for receiving the end of the solid hockey stick handle (i.e., shaft) of wood or composite construction. Although the grip may improve the handling comfort of the player, methods for inserting and removing the hockey stick handle into and from the handle recess can be difficult. The '681 application suggests blowing compressed air into the handle recess in order to insert or remove the handle from the grip. The inconvenience of using a compressed air supply is likely to discourage removing the grip, for example, if the stick were to break. Another disadvantage is that after inserting the hockey stick handle into the sleeve, the sleeve is thicker and bulkier than the stick handle itself, making the sleeve uncomfortable to grasp because, for some users, the thickness is too large for their hand. Accordingly, there is a need for a comfortable grip that can be used with the new-construction hockey sticks without the aforementioned disadvantages.

SUMMARY

In one aspect, the invention features a grip for attachment to a sport stick having a shaft. One end of the shaft has an opening extending longitudinally into the shaft along a longitudinal axis. The grip comprises an elongated grip portion has a hilt sized for being grasped by a hand. An insertion portion extends from one end of the elongated grip portion. The insertion portion is sized to provide close insertion into the opening at the one end of the shaft. The elongated grip portion extends lengthwise from the one end of the shaft approximately along the longitudinal axis defined by the shaft of the sport stick when the insertion portion is inserted into the opening of the shaft.

In another aspect, the invention features a grip for attachment to a sport stick having a shaft. The shaft has an opening at one end extending longitudinally into the shaft along a longitudinal axis. The grip comprises a hilt with a longitudinal dimension that is sized for being grasped by a hand. The grip also has means for connecting the hilt to the shaft. The connecting means includes an insertion portion that is inserted into the opening at the one end of the shaft. The hilt extends lengthwise from the one end of the shaft approximately along the longitudinal axis defined by the shaft when the insertion portion is inserted into the opening.

In yet another aspect, the invention features a hockey stick comprising a hockey stick shaft and a grip attached to the shaft. The hockey stick shaft has an opening at a first end. The opening extends longitudinally from the first end into the shaft along an longitudinal axis. The grip has an insertion portion and a grip portion. The insertion portion is inserted into the opening at the first end of the hockey stick shaft. The grip portion has a hilt with a longitudinal dimension that is sized for being grasped by a hand of a user. The hilt extends approximately along the longitudinal axis defined by the shaft and has a curved surface along a length of the hilt that conforms to a curvature of a palm of the hand.

In still another aspect, the invention features a grip for attachment to a sport stick having a shaft. One end of the shaft has an opening extending longitudinally into the shaft. The grip has an elongated grip portion having a hilt. The hilt has a longitudinal dimension that is sized for being grasped by a hand of a user. The grip also has an insertion portion adjacent to one end of the elongated grip portion. The insertion portion is sized to provide close insertion into the opening at the one end of the shaft.

In still yet another aspect, the invention features a sport stick comprising a shaft and a grip attached to the shaft. The shaft has an opening at a first end. The opening extends longitudinally from the first end into the shaft. The grip has an insertion portion and a grip portion. The insertion portion is inserted into the opening at the first end of the shaft. The grip portion has a hilt with a longitudinal dimension that is sized for being grasped by a hand of a user.

In still another aspect, the invention features a grip for attachment to a hockey stick having a shaft. One end of the shaft has an opening extending longitudinally into the shaft. The grip comprises an elongated grip portion having a hilt with a longitudinal dimension sized for being grasped by a hand of a user and a guard portion located at the one end of the hilt. An insertion portion extends from one end of the elongated grip portion. The insertion portion is sized to provide close insertion into the opening at the one end of the shaft. The guard portion of the grip portion borders the one end of the shaft when the insertion portion is inserted into the opening of the shaft.

BRIEF DESCRIPTION OF THE DRAWINGS

The above and further advantages of this invention may be better understood by referring to the following description in conjunction with the accompanying drawings, in which like numerals indicate like structural elements and features in various figures. The drawings are not necessarily to scale, emphasis instead being placed upon illustrating the principles of the invention.

DETAILED DESCRIPTION

In brief overview, the present invention features an ergonomic grip that is used with a sport stick. The grip is particularly adapted for use with hollow hockey sticks, such as the new construction aluminum and composite sticks, and provides comfort and style that a player cannot typically achieve with the traditional method of taping the gripped end of the sport stick. Although described with reference to hockey sticks (e.g., ice, street, and floor), it is to be understood that the principles of the invention also apply to other types of sticks, such as lacrosse sticks and walking sticks, provided such sticks have hollow or hollow-ended shafts, and to sticks constructed of different types of materials or substances, for example, titanium, and to combinations of different materials and substances.

Figure 1:
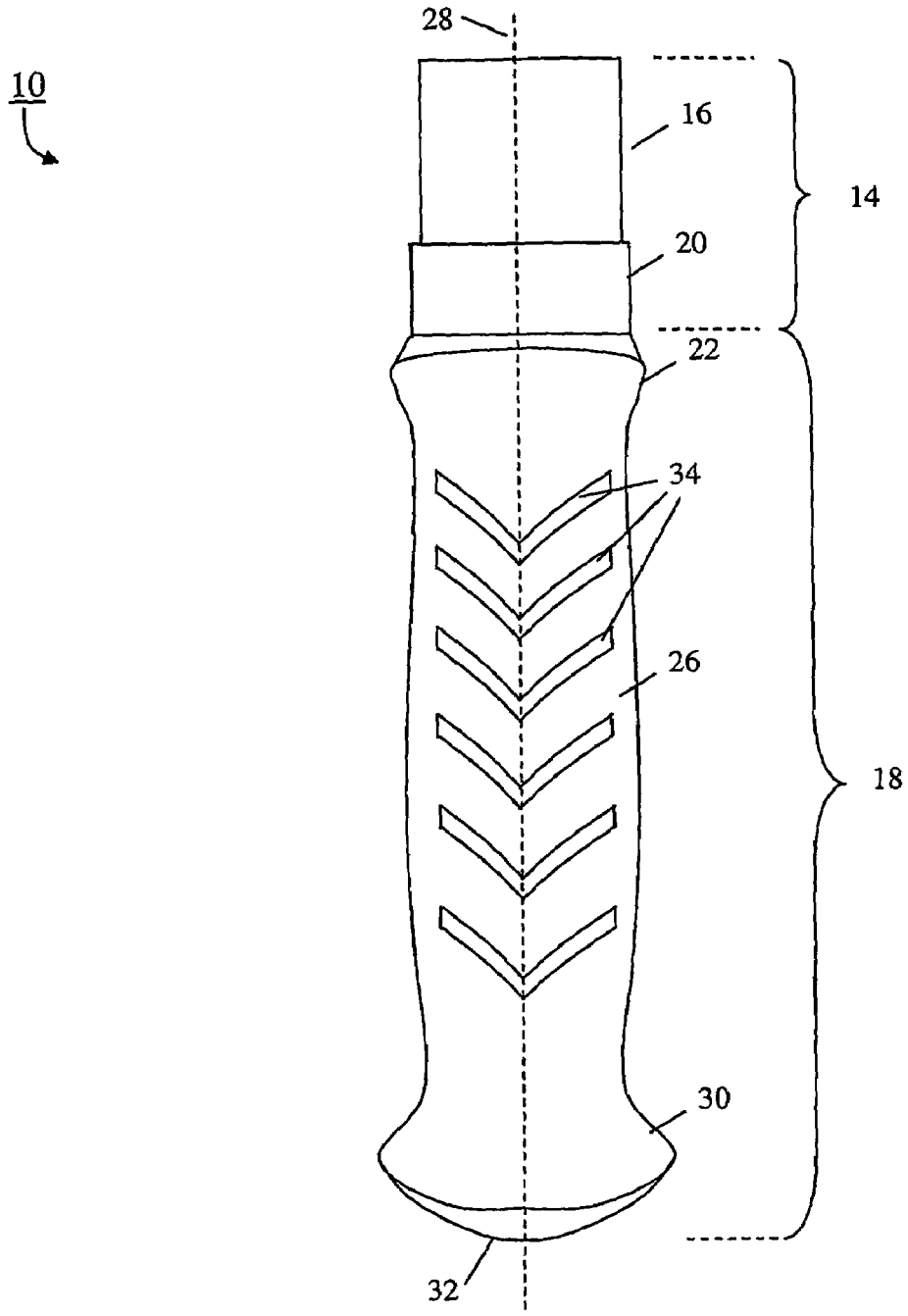
FIG. 1 is a front view of one embodiment of a grip, constructed in accordance with the invention, for use with a sport stick.

FIG. 1 shows a front view of an embodiment of a sport stick grip 10 constructed in accordance with the principles of the invention. The grip 10 includes a shaft interface portion 14 and a grip portion 18. The shaft interface portion 14 has an insertion portion 16 that enters partially or completely into an opening at one end of a hollow or partially hollow shaft. The insertion portion 16 has cross-section dimensions that provide a close fit into the shaft.

For example, hollow hockey stick shafts (or handles) are rectangular in cross-section and have outer dimensions of approximately 0.75 inches by 1.125 inches. Inner dimensions are approximately 0.625 inches by 1.02 inches. To fit snugly within the stick shaft, in one embodiment the cross-section dimensions of the insertion portion 16 are sized to be slightly smaller than inner cross-section dimensions of the opening in the hockey stick shaft so the insertion portion 16 can be slid directly into the opening. In another embodiment, the cross-section dimensions are the same as or slightly larger than the inner cross-section dimensions of the opening in the hockey stick shaft. In this embodiment, the insertion portion 16 is press (or interference) fit into the shaft opening.

The insertion portion 16 is also sufficiently long to enable a solid connection to be formed between the grip 10 and the stick shaft. Embodiments of the grip 10 have insertion portions 16 with lengths ranging from approximately 0.25 to approximately 3.5 inches. Insertion portions 16 can be constructed with different lengths without departing from the principles of the invention.

The shaft interface 14 also includes a shaft stop 20. The shaft stop 20 can have dimensions that are smaller, the same as, or slightly larger than the cross-section dimensions of the sport stick. When such dimensions are larger than the cross-section dimensions of the sport stick, the shaft stop 20 prevents the edge of the stick shaft from making contact with the grip portion 18.

The grip portion 18 includes a hilt 26 and optionally, a guard portion 22 and a knob 30. The user of the sport stick (with an attached grip 10) grasps the hilt 26 with one hand along a longitudinal axis 28. The length of the hilt 26 (i.e., from guard portion 22 to knob 30) is sized to receive the entire hand. In some embodiments, the length of the hilt 26 accommodates a gloved hand. Other hilt 26 embodiments are sized for an ungloved (i.e., bare) hand. Embodiments of the grip 10 have hilts of various diameters or thicknesses (i.e., for accommodating the different hand and glove sizes in the general population). For example, the hilt 26 can be thicker, thinner, or of the same thickness as the hockey stick shaft.

Optionally, the hilt 26 has a plurality of ridges 34 that increases the surface area that comes into contact with the hand of the user, and thus improves the user's grasp of the grip 10. The number, shape, and style of the ridges 34 shown in FIG. 1 are merely exemplary, and do not limit the scope of the principles of the invention. In some embodiments, the ridges 34 are raised from the surface of the hilt 26. In other embodiments the ridges 34 are depressions in the surface of the hilt 26. In yet other embodiments, both types of ridges 34 are used.

The guard portion 22 blocks another sport stick (e.g., of an opponent), during the course of a game, from sliding over the shaft onto the hilt 26 and striking the user's hand. The design of the guard portion 22 can vary. For example, embodiments of the guard portion 22 include a crosspiece, as shown, a curved shield that protects the fingers, or a full basket that nearly envelopes the hand. Like the guard portion 22, the knob 30 is larger in diameter than the hilt 26. The knob 30 helps keep the sport stick from sliding out of the hand of the user during game play. Also, the end 32 of the knob 30 is curved to mitigate injury should the grip end of the stick strike or spear another player. Another advantage is that the knob 30 prevents the end of the stick from entering the mask of another player.

Figure 2:
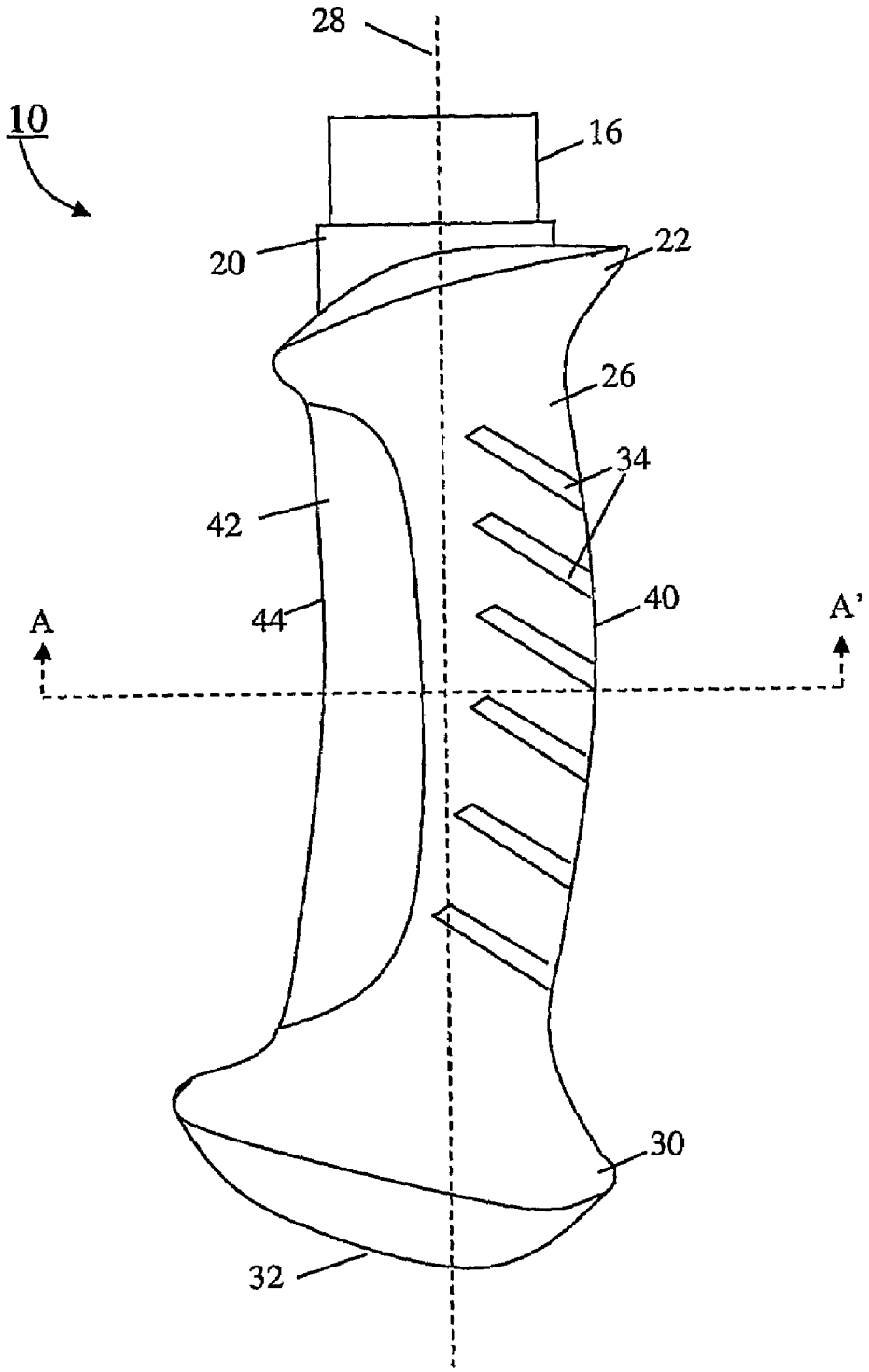
FIG. 2 is a side view of the grip shown in FIG. 1.

FIG. 2 shows a side view of the embodiment of the sport stick grip 10 shown in FIG. 1. In addition to the grip features shown in FIG. 1, this side view illustrates that the hilt 26, on one side, has a first surface 40 with a longitudinal curvature (i.e., from guard portion 22 to knob 30) and, on another side, a second longitudinal surface 44, which in one embodiment is approximately planar. Different embodiments of the grip 10 have surfaces 40, 44 with varying degrees of curvature to accommodate the varying hand sizes in the general population and intended uses (e.g., with or without gloves) for the stick. For example, other embodiments of the grip 10 have hilts 26 that are approximately rectangular in shape (longitudinally) and have first and second longitudinal surfaces 40, 44 that are substantially straight.

Figure 3A:
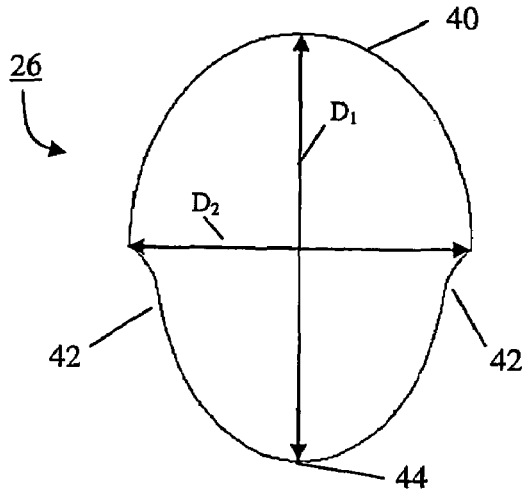
FIG. 3A is a cross-section view of embodiment of a universal grip of the present invention along line A-A' shown in FIG. 2.
Figure 3B:
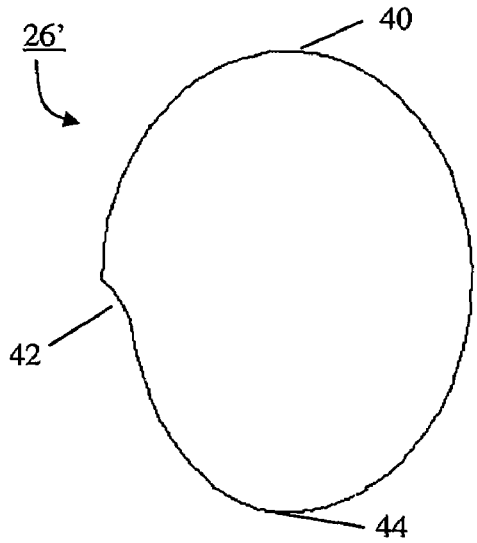
FIG. 3B is a cross-section view of an embodiment of a right-handed grip of the present invention along line A-A' shown in FIG. 2.
Figure 3C:
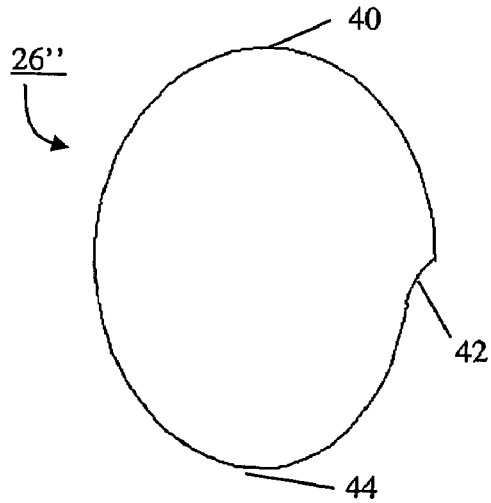
FIG. 3C is a cross-section view of an embodiment of a left-handed grip of the present invention along line A-A' shown in FIG. 2.

Optionally, the hilt 26 also has an indentation 42 for receiving fingers that wrap around the hilt 26. FIG. 3A, FIG. 3B, and FIG. 3C show cross-sections of different embodiments of the hilt 26, 26', and 26" (generally, hilt 26), showing the indentation 42 for universal, right-handed, or left-handed use, respectively. Each cross-section is along line A-A' in FIG. 2 and shows that the first surface 40 on one side of the hilt 26 (i.e., facing the palm of the hand) and the second surface 44 on the opposite side of the hilt 26 (i.e., facing the fingers) each have a latitudinal curve. FIG. 3A also shows diameters D1 and D2 of the hilt 26. Either or both diameters D1 and D2 of the hilt 26 can be shorter or have the same length as the corresponding dimension of the hockey stick shaft. (Diameter D1 corresponds to the longer cross-sectional dimension of the hockey stick shaft and diameter D2 corresponds to the shorter cross-sectional dimension of the hockey stick shaft.)

Figure 4:
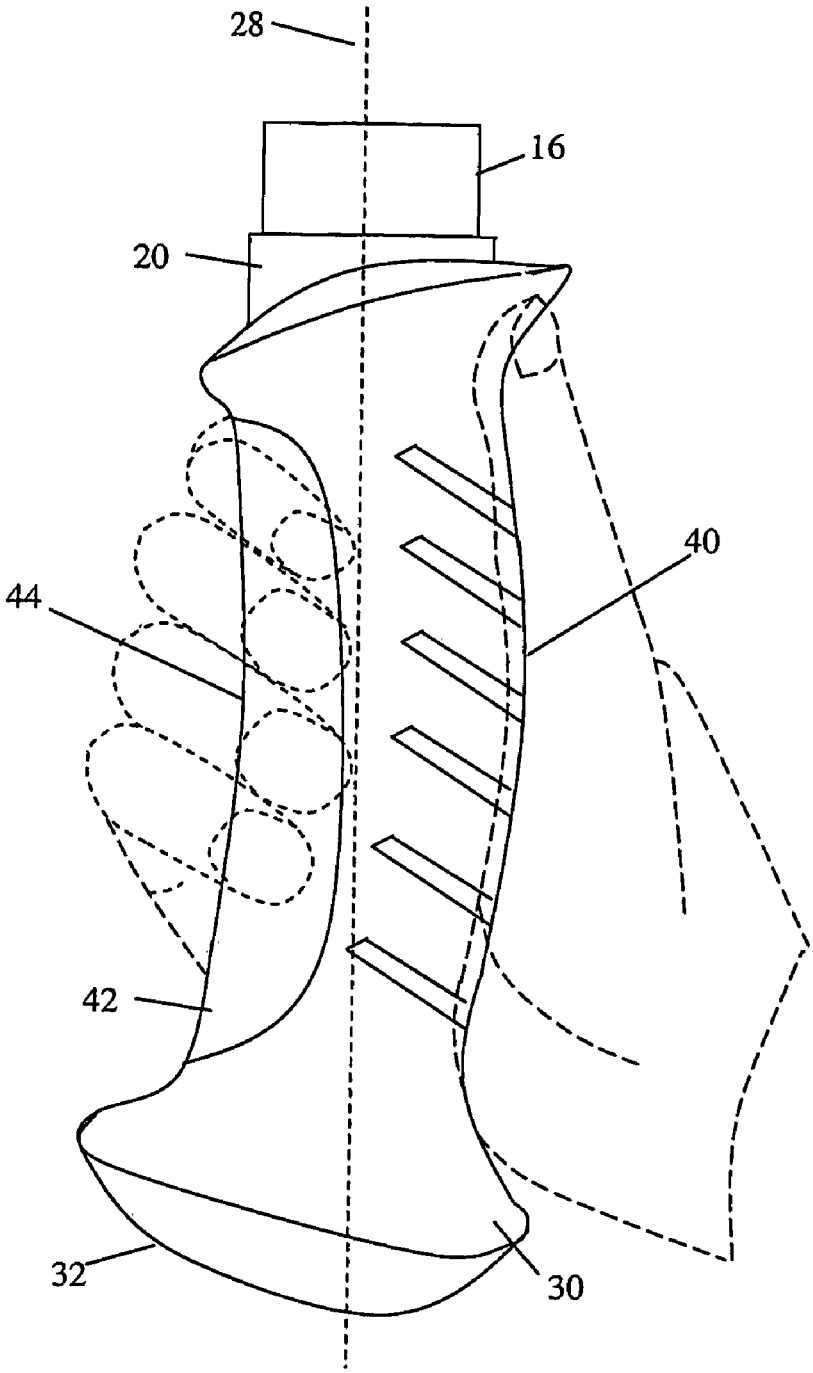
FIG. 4 is a side view of the grip shown in FIG. 2 being grasped by an ungloved hand.
Figure 5:
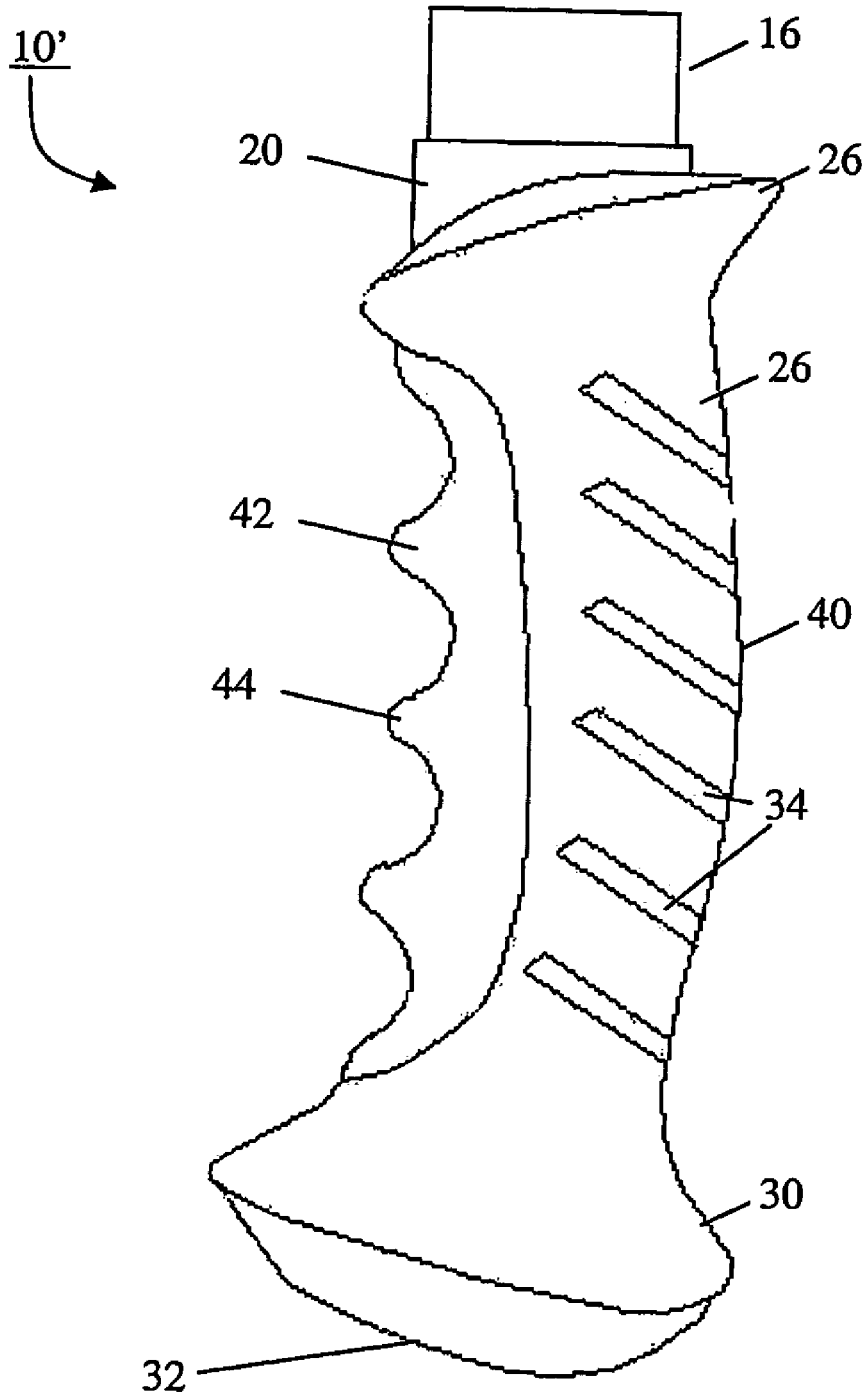
FIG. 5 is a side view of another embodiment of the grip of the invention with individual finger indentations.

When a user's hand grasps the grip 10, as shown with dashed lines in FIG. 4, part of the surface 40 presses against the palm of the hand, the fingers wrap around the surface 44 of the hilt 26, and the tips of the fingers lay in the indentation 42. For those embodiments with such features, the curved surfaces 40, 44 and indentation 42 improve the comfortable feel of the grip 10 in the user's hand. In some embodiments, the indentation 42 is a single large depression for receiving each of the fingers that wrap around the hilt 26, or separate depressions each sized to receive a single finger (as shown in FIG. 5).

Figure 6A:
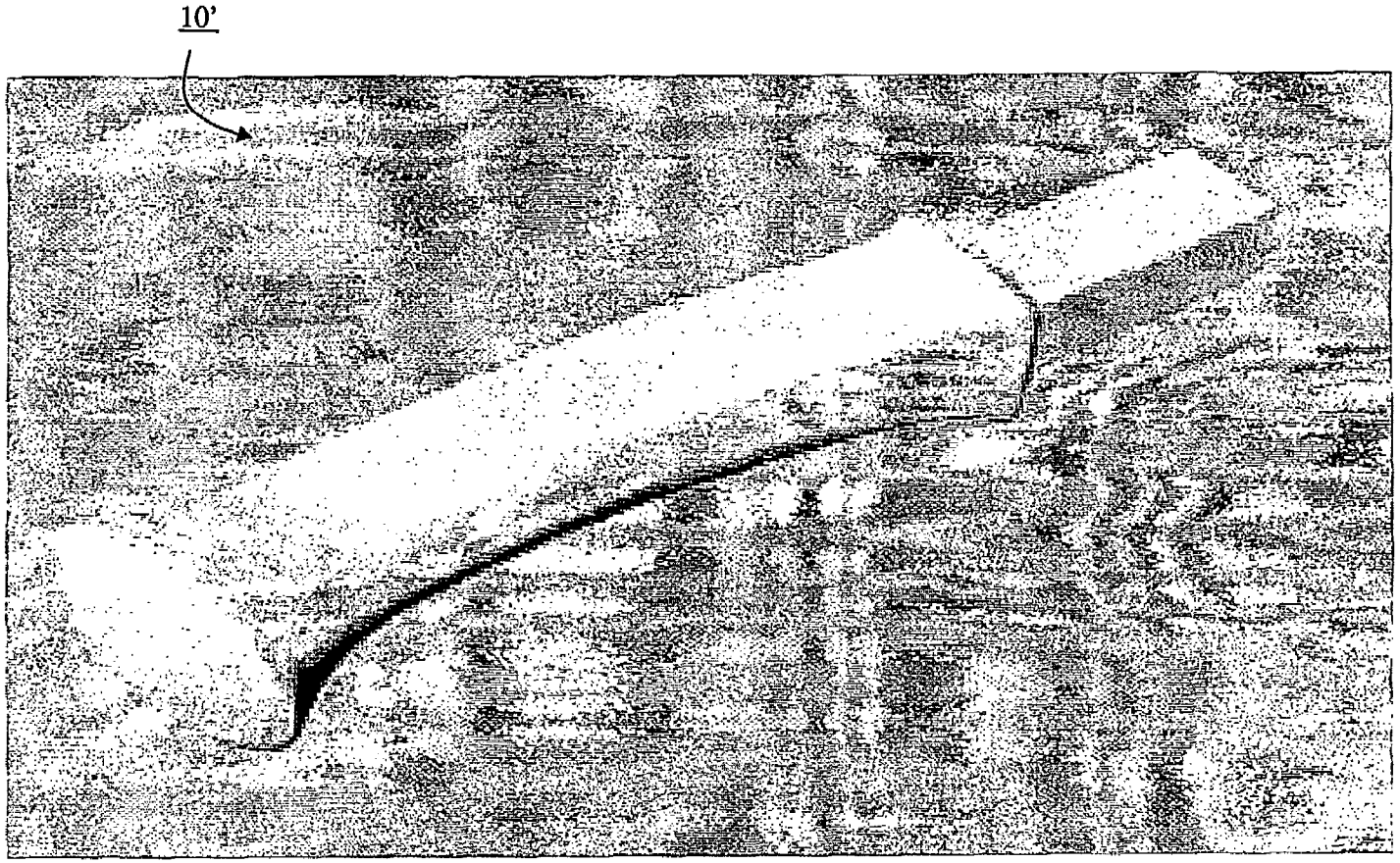
FIG. 6A is view of an embodiment of a curved grip constructed as a single integral piece.
Figure 6B:
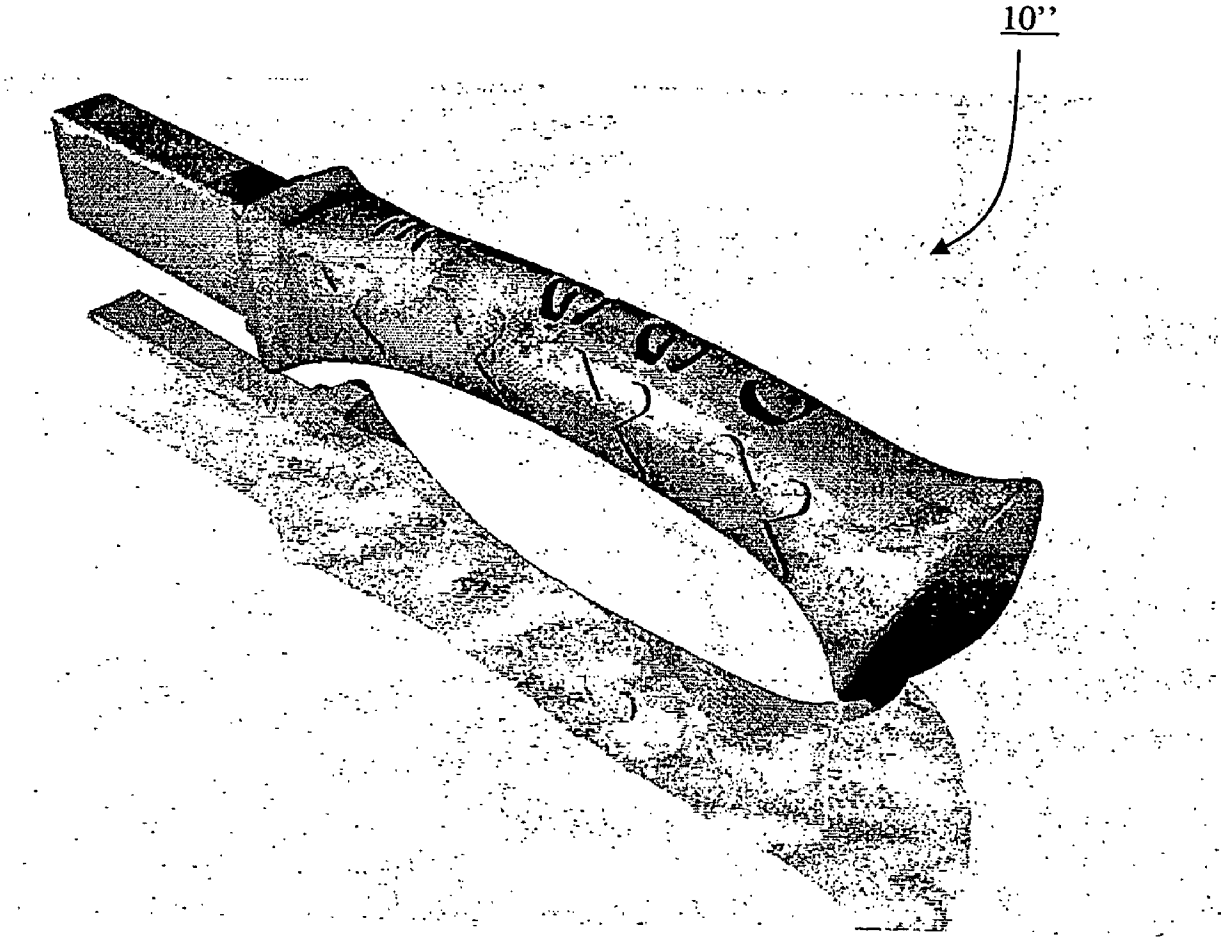
FIG. 6B is view of another embodiment of a curved grip of the invention.
Figure 6C:
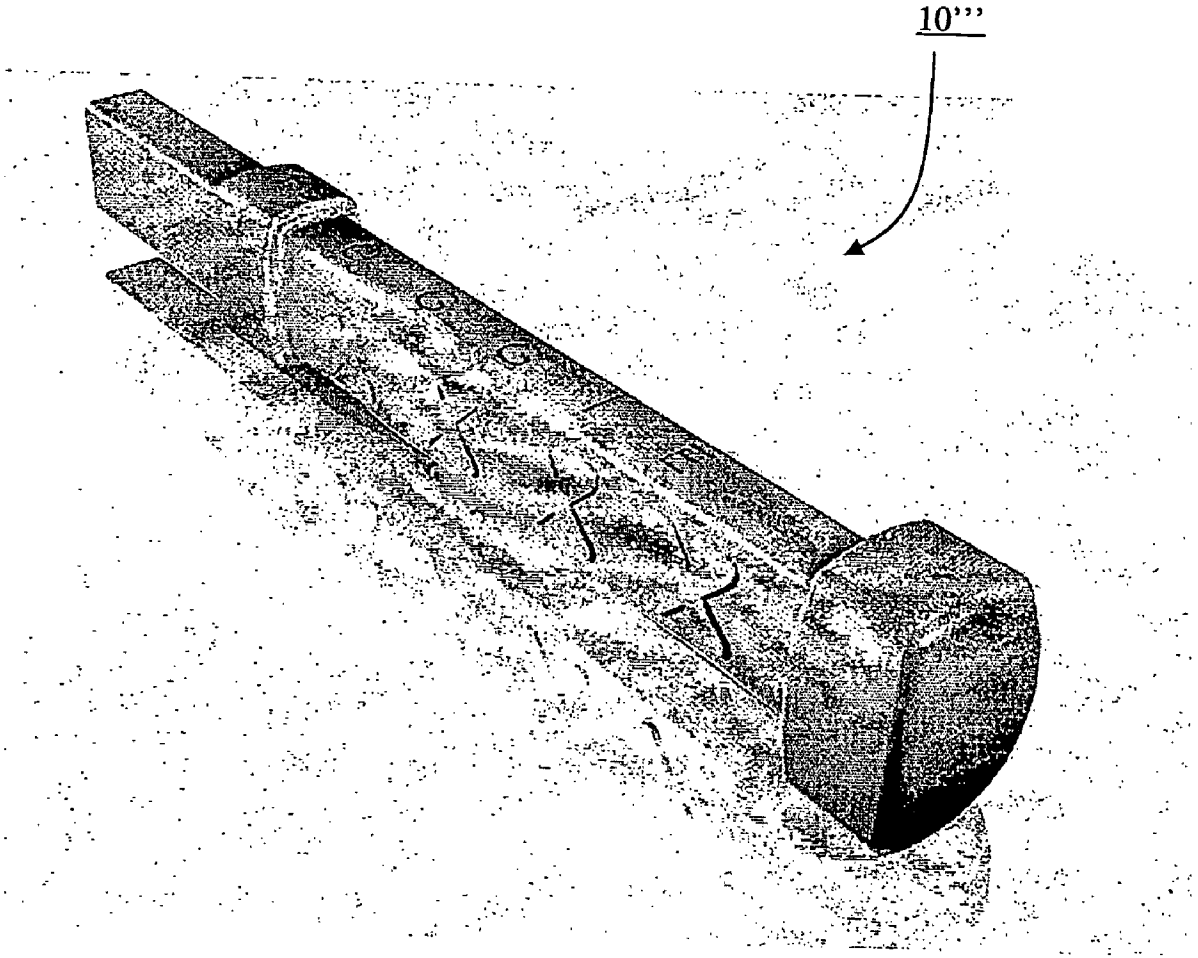
FIG. 6C is a view of an embodiment of a straight grip of the invention.

FIG. 6A, FIG. 6B, and FIG. 6C show various embodiments of grips of the invention. FIG. 6A shows a curved grip 10' constructed as a single (i.e., integral) piece. The grip 10' is constructed of a resilient material, such as polyvinyl. Other types of construction materials for an integral grip 10 include, but are not limited to, wood, plastic, metal, composite, thermoplastic elastomer, synthetic rubber, rubber, and combinations thereof. FIG. 6B shows another embodiment of a curved grip 10", here constructed from a plurality of components, as described in more detail in FIG. 7A. FIG. 6C shows an embodiment of a straight grip 10'", here constructed from a plurality of components, as described in more detail in FIG. 7B. It is to be understood that the straight grip 10'" can also be constructed of an integral piece of material, such as the curved grip 10' of FIG. 6A.

Figure 7A:
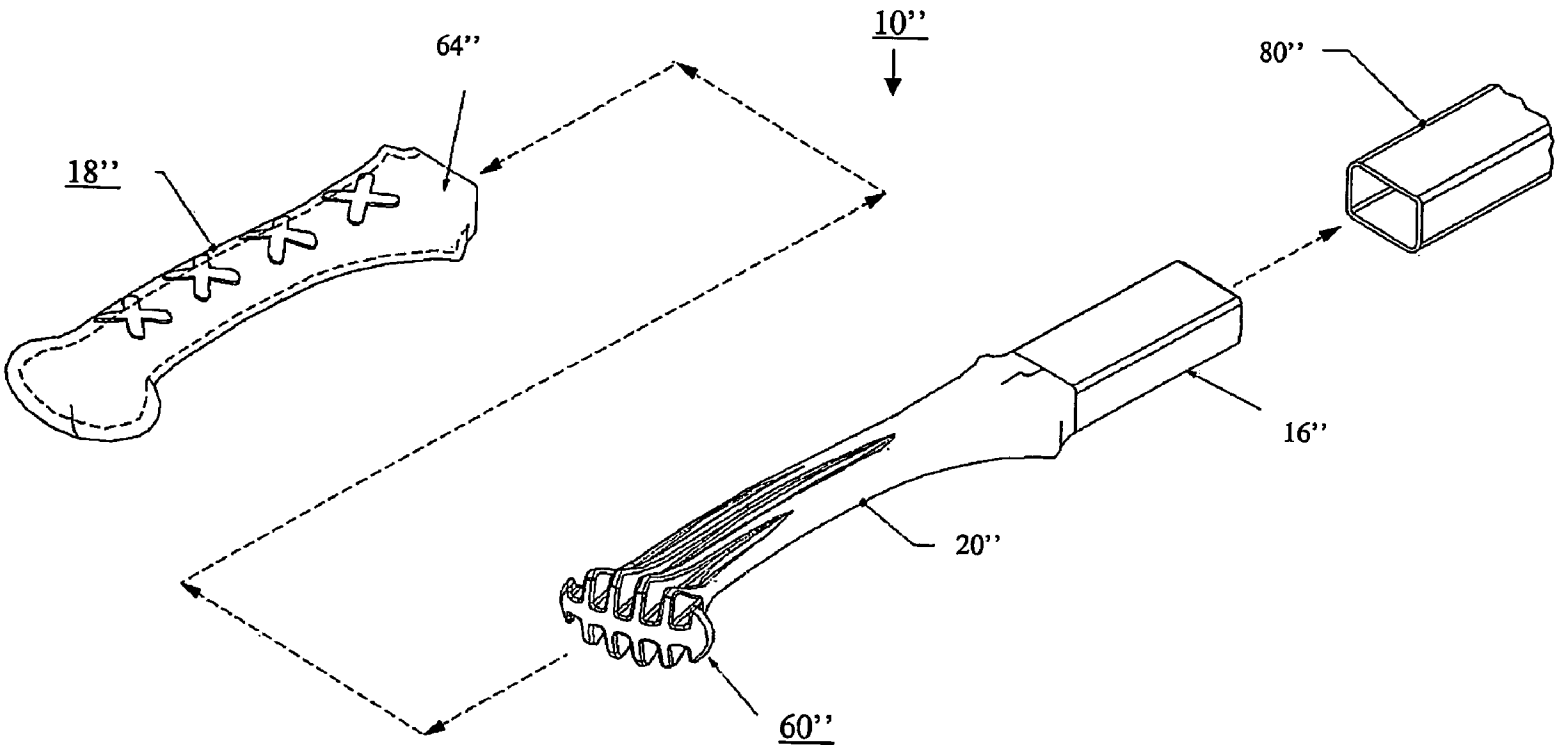
FIG. 7A is a view of a grip core according to one embodiment of the invention.
Figure 7B:
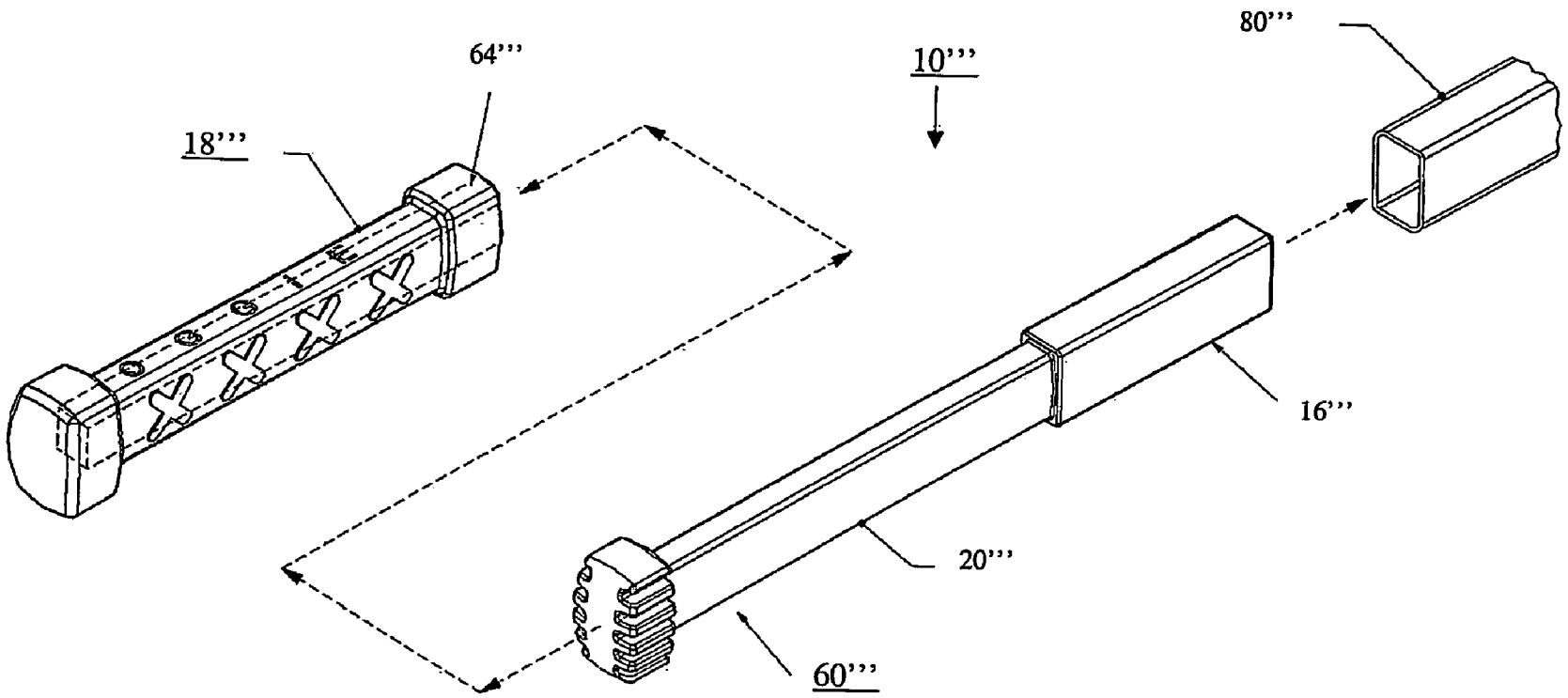
FIG. 7B is a view of a grip portion according to one embodiment of the invention.

FIG. 7A and FIG. 7B each show the construction of an embodiment of a grip 10", 10'", respectively, as a plurality of pieces. FIG. 7A shows a grip core 60", including an insertion portion 16" and a shaft stop 20", and a grip portion 18", including a bore 64" that extends into the grip portion 18", for receiving the grip core 60". Similarly, FIG. 7B shows a grip core 60'", including an insertion portion 16'" and a shaft stop 20'", and a grip portion 18'", including a bore 64'" that extends into the grip portion 18'", for receiving the grip core 60'". Hereafter, the prime designations (" and '") are dropped to simplify the description of these embodiments. The construction material of each grip core 60 is generally designed to provide a solid skeletal structure for the grip portion 18. Examples of construction material include thermoplastic composite (e.g., a combination of fiberglass and thermoplastic), thermoplastics, and thermosets. Different embodiments of the grip core 60 have different degrees of stiffness (or, conversely, flexibility). In general, the stiffness of the grip core 60 is designed to cooperate with the stiffness or flexibility of the shaft of the hockey stick. Accordingly, a grip core 60 with flexibility enables the grip 10 to flex with the flexing of the hockey stick. Stiffness ratings currently used to rate the stiffness of hockey sticks can also be used to rate the stiffness of the grip core 60 (and, correspondingly, the grip 10).

As shown in FIG. 7A and in FIG. 7B, the shaft stop 20 is thinner than the insertion portion 16 so that when the grip core 60 is within the bore 64, the thickness of the hilt of the grip 10 approximates the thickness of the hockey stick shaft. As described above, the thickness of the hilt can be less than, equal to, or greater than the thickness of the hockey stick shaft. The thickness of the hilt depends, in part, on the thickness of the grip core 60. Also, the grip core 60 can be solid or hollow, and examples of construction material include, but are not limited to, wood, plastic, metal, composite, or rubber. Examples of construction material for the grip portion 18 include, but are not limited to, plastic, rubber, synthetic rubber, and composite. One embodiment of the grip portion 18 is constructed of thermoplastic elastomer (TPE) manufactured by GLS Corporation of McHenry, Ill. Embodiments of the grip portion 18 that are constructed of resilient material such as TPE, synthetic rubber, and rubber provide a comfortable, grippy or soft feel, particularly to a bare hand. Methods of manufacturing cores and grip portions of such materials are known in the art.

Methods for combining the grip core 60 and the grip portion 18 to produce the grip 10 are also known in the art. In one embodiment, the grip portion 18 is formed, molded around, or over-molded over the grip core 60. In another embodiment, the grip portion 18 is produced separately from the grip core 60, and the grip core 60 is subsequently inserted into the bore 64 of the grip portion 18. Optionally, the grip portion 18 has a small opening at one end (opposite the end that receives the grip core 60) to facilitate insertion of the grip core 60 by allowing air to escape when the grip core 60 is inserted. An epoxy (or glue, in general) firmly fastens the grip core 60 within the grip portion 18. For both types of methods, once the grip core 60 is fixed within the grip portion 18, the insertion portion 16 projects from the grip portion 18, and, for the embodiments shown in FIG. 7A and FIG. 7B, the shaft stop 20 is encased by the grip portion 18 (i.e., the stick shaft abuts the guard portion 22 of the grip portion 18 when connected to the grip 10).

Figure 8A:
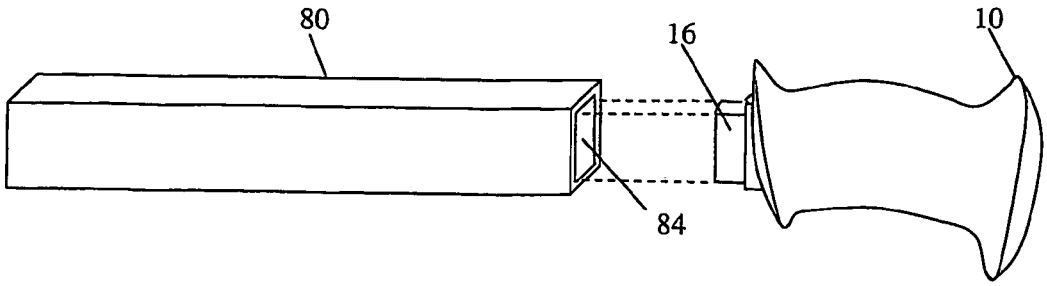
FIG. 8A is a view of a sport stick shaft aligned for attachment with one embodiment of the grip of the invention.

FIG. 8A shows a shaft 80 of a sport stick and grip 10 of the invention prior to attachment.

The insertion portion 16 of the grip 10 is aligned with an opening 84 at one end of the sport stick shaft 80. In one embodiment, heat-activated adhesive (e.g., glue, epoxy) coats the insertion portion 16. To attach the grip 10 to the shaft 80, the user places the insertion portion 16 into the shaft opening 84 and heats the shaft 80 in the vicinity of the insertion portion 16. Alternatively, the adhesive is heated prior to inserting the insertion portion 16 into the shaft 80. The heat causes the adhesive to soften and contact the inside walls of the shaft 80. Upon cooling, the adhesive solidifies and affixes the insertion portion 16 to the inside walls of the shaft 80. Because the insertion portion 16 is sized to fit closely within the shaft 80, an adhesive may not be necessary to achieve a secure attachment. This is particularly applicable to those embodiments in which the insertion portion 16 is press fit into the opening of the shaft 80. In other embodiments, a different type of fastener 88 (FIG. 8B), such as a bolt or screw, is used instead of or in addition to the adhesive to affix the handle to the shaft 80.

Figure 8B:
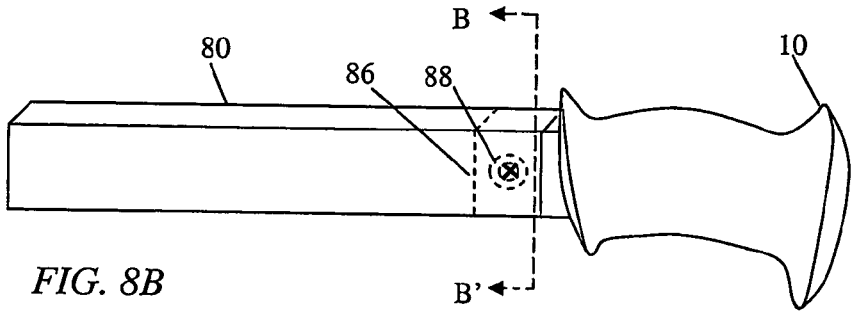
FIG. 8B is a view of the sport stick shaft attached to one embodiment of the grip of the invention.
Figure 8C:
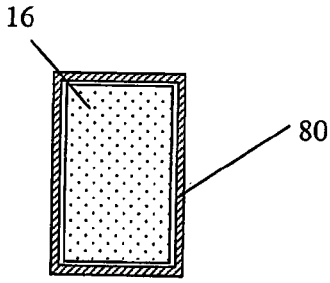
FIG. 8C is a cross-section view along the line B-B' of FIG. 8B at a point along the sport stick shaft where the grip is inserted in the shaft.
Figure 8D:
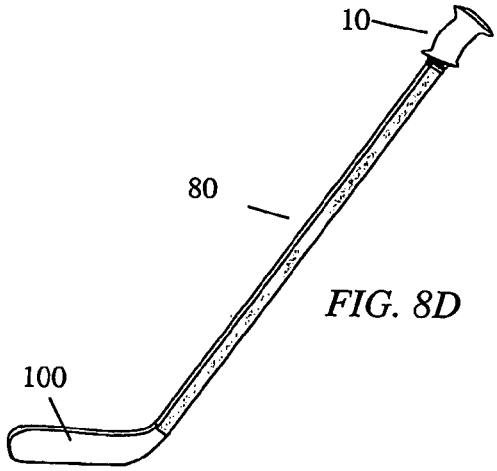
FIG. 8D is a diagram of an embodiment of a hockey stick having a grip of the invention attached thereto.

FIG. 8B shows the grip 10 after attachment to the sport stick shaft 80. The extent of penetration of the insertion portion 16 within the shaft 80 is indicated by the dashed line 86. FIG. 8C shows a cross-section along the line B-B' in FIG. 8B, illustrating an example of a close fit between the insertion portion 16 and the inside walls of the shaft 80. Although not shown in FIG. 8C, some contact between the insertion portion 16 and the inside walls can occur at some point along the shaft 80. For the typical hockey stick, the cross-section is rectangular. It is to be understood that for other types of sticks, the cross-section can have different shapes, such as triangular (e.g., particular hockey sticks), hexagonal (e.g., for lacrosse sticks), elliptical, octagonal, circular. FIG. 8D shows an embodiment of a hockey stick including the grip 10 attached to one end of the shaft 80 and a hockey stick blade 100 attached to the other end of the shaft 80.

Occasionally, the user may desire to remove the grip 10 from the shaft 80. For example, normal wear and tear, the sport stick may break, the user's hands may grow in size, or the user may desire a differently shaped grip or grip color. To remove the grip 10, the user pulls the grip 10 with sufficient force to remove the insertion portion 16 from the shaft. If a heat-activated adhesive is used to secure the grip 10 to the shaft, the user heats the shaft 80 in the vicinity of the insertion portion 16 to soften the adhesive sufficiently to allow the grip 10 to be pulled from shaft 80.

While the invention has been shown and described with reference to specific preferred embodiments, it should be understood by those skilled in the art that various changes in form and detail may be made therein without departing from the spirit and scope of the invention as defined by the following claims. For example, a grip constructed according to the principles of the invention can be constructed in an assortment of colors, and in a variety of distinctive ergonomic styles; that is, the color, shape, and dimensions of each grip can be customized to satisfy a particular player's taste and physical requirements (e.g., the size of hands and gloves, if worn), and the type of sport played (street hockey, ice hockey, field hockey, floor hockey, lacrosse, etc).

What is claimed is:

1. A grip for attachment to a sport stick having a shaft, one end of the shaft having an opening extending longitudinally into the shaft along a longitudinal axis, the grip comprising:

a grip core having a hilt portion and one or more grooves formed in the hilt portion, each groove having a depth that varies along a length of that groove;

an elongated grip portion covering one end of the grip core and the one or more grooves, the elongated grip portion having a hilt sized for being grasped by a hand; and an insertion portion extending from one end of the grip core, the insertion portion being sized to provide close insertion into the opening at the one end of the shaft, the elongated grip portion extending lengthwise from the one end of the shaft approximately along the longitudinal axis defined by the shaft of the sport stick when the insertion portion is inserted into the opening of the shaft.

2. The grip of claim 1, wherein the one or more grooves includes at least two grooves with different lengths.

3. The grip of claim 1, wherein the one or more grooves extends from the hilt portion into a knob portion of the grip core.

4. The grip of claim 1, wherein the one or more grooves formed in the hilt portion of the grip core each extends along a partial length of the hilt portion.

5. The grip of claim 1, wherein the hilt has a curved longitudinal surface that conforms to a curvature of a palm of the hand.

6. The grip of claim 1, wherein the hilt has a diameter that is smaller than a corresponding cross-sectional dimension of the shaft of the sport stick.

7. The grip of claim 1, wherein the hilt has a diameter that is as large as or larger than a corresponding cross-sectional dimension of the shaft of the sport stick.

8. The grip of claim 1, wherein the grip portion includes a guard portion at the one end of the hilt.

9. The grip of claim 1, wherein the grip portion includes a knob at one end of the grip portion.

10. The grip of claim 1, wherein the hilt has an indentation in a surface for receiving one or more fingers when the palm of the hand presses against the longitudinally curved surface.

11. The grip of claim 1, wherein the insertion portion and the grip portion are constructed of different materials.

12. A grip for attachment to a sport stick having a shaft, the shaft having an opening at one end extending longitudinally into the shaft along a longitudinal axis, the grip comprising:

a hilt having a longitudinal dimension sized for being grasped by a hand; and means for connecting the hilt to the shaft, the connecting means including a grip core and an insertion portion, the grip core having a hilt portion and one or more grooves formed in the hilt portion, each groove having a depth that varies along a length of that groove, the insertion portion being inserted into the opening at the one end of the shaft, the hilt extending lengthwise from the one end of the shaft approximately along the longitudinal axis defined by the shaft when the insertion portion is inserted into the opening.

13. The grip of claim 12, wherein the one or more grooves includes at least two grooves with different lengths.

14. The grip of claim 12, wherein the one or more grooves extend from the hilt portion into a knob portion of the grip core.

15. The grip of claim 12, wherein the one or more grooves formed in the hilt portion of the grip core each extends along a partial length of the hilt portion.

16. The grip of claim 12, wherein the hilt has a curved longitudinal surface that conforms to a curvature of a palm of the hand.

17. The grip of claim 12, wherein the hilt has a diameter that is smaller than a corresponding cross-sectional dimension of the shaft of the sport stick.

18. The grip of claim 12, wherein the hilt has a diameter that is as large as or larger than a corresponding cross-sectional dimension of the shaft of the sport stick.

19. The grip of claim 12, wherein the hilt has a curved longitudinal surface that conforms to a curvature of a palm of the hand.

20. The grip of claim 12, further comprising means, disposed at the one end of the hilt, for guarding the hand grasping the hilt.

21. The grip of claim 12, further comprising means for restricting the hand from sliding off the hilt.

22. The grip of claim 21, wherein the restricting means includes a knob at the other end of the hilt.

23. The grip of claim 21, wherein the restricting means includes ridges on a surface of the hilt.

24. The grip of claim 15, wherein the hilt includes means for receiving one or more fingers when the hand grasps the hilt.

25. A hockey stick, comprising:

a hockey stick shaft having an opening at a first end, the opening extending longitudinally from the first end into the shaft along an longitudinal axis; and a grip having a grip core, an insertion portion and a grip portion, the grip core having a hilt portion and one or more grooves formed in the hilt portion, each groove having a depth that varies along a length of that groove, the insertion portion being inserted into the opening at the first end of the hockey stick shaft, the grip portion covering one end of the grip core and the one or more grooves and having a hilt with a longitudinal dimension sized for being grasped by a hand of a user, the hilt extending approximately along the longitudinal axis defined by the shaft and having a curved surface along a length of the hilt that conforms to a curvature of a palm of the hand.

26. The hockey stick of claim 25, wherein the one or more grooves includes at least two grooves with different lengths.

27. The hockey stick of claim 25, wherein the one or more grooves extend from the hilt portion into a knob portion of the grip core.

28. The hockey stick of claim 25, wherein the one or more grooves formed in the hilt portion of the grip core each extends along a partial length of the hilt portion.

29. The hockey stick of claim 25, wherein the hilt has a curved longitudinal surface that conforms to a curvature of a palm of the hand.

30. The hockey stick of claim 25, wherein the hilt has a diameter that is smaller than a corresponding cross-sectional dimension of the shaft of the hockey stick.

31. The hockey stick of claim 25, wherein the hilt has a diameter that is as large as or larger than a corresponding cross-sectional dimension of the shaft of the sport stick.

32. The hockey stick of claim 25, further comprising a fastener securing the insertion portion of the grip to the shaft.

33. The hockey stick of claim 32, wherein the fastener is an adhesive.

34. The hockey stick of claim 25, further comprising a hockey stick blade attached to a second end of the shaft.

35. The hockey stick of claim 25, wherein a longitudinal length of the hilt is sized for being grasped by a gloved hand.

36. The hockey stick of claim 35, wherein a longitudinal length of the hilt is sized for being grasped by a bare hand.

37. The hockey stick of claim 35, wherein the grip portion includes a guard portion at the one end of the hilt.

38. The hockey stick of claim 35, wherein the grip portion includes a knob at one end of the hilt.

39. A sport stick, comprising:

a shaft having an opening at a first end, the opening extending longitudinally from the first end into the shaft;

a grip having a grip core, an insertion portion and a grip portion, the grip core having a hilt portion, a knob portion at one end of the hilt portion, and one or more grooves formed in the knob portion, each groove in the knob portion terminating before reaching the hilt portion, the insertion portion being inserted into the opening at the first end of the shaft, the grip portion covering one end of the grip core and the one or more grooves and having a hilt with a longitudinal dimension sized for being grasped by a hand of a user, the hilt having a curved surface along a length of the hilt that conforms to a curvature of a palm of the hand.

* * * * *

UNITED STATES PATENT AND TRADEMARK OFFICE

CERTIFICATE OF CORRECTION

PATENT NO. : 7,288,036 B2
APPLICATION NO. : 10/542981
DATED : October 30, 2007
INVENTOR(S) : Casasanta, Jr.

It is certified that error appears in the above-identified patent and that said Letters Patent is hereby corrected as shown below:

In the Claims:

In Claim 36, column 10, line 16, delete "35" and substitute --25--.

In Claim 37, column 10, line 18, delete "35" and substitute --25--.

In Claim 38, column 10, line 20, delete "35" and substitute --25--.

Signed and Sealed this

Twentieth Day of May, 2008

JON W. DUDAS
*Director of the United States Patent and Trademark Office*